US009745681B2

(12) United States Patent
Warwick

(10) Patent No.: US 9,745,681 B2
(45) Date of Patent: Aug. 29, 2017

(54) EMBROIDERY HOOP MOUNTING APPARATUS AND METHOD

(71) Applicant: Artist's Needle, Inc., Greensboro, NC (US)

(72) Inventor: Michael Yates Warwick, Greensboro, NC (US)

(73) Assignee: Artist's Needle, Inc., Greensboro, NC (US)

( * ) Notice: Subject to any disclaimer, the term of this patent is extended or adjusted under 35 U.S.C. 154(b) by 236 days.

(21) Appl. No.: 14/825,431

(22) Filed: Aug. 13, 2015

(65) Prior Publication Data

US 2017/0044700 A1 Feb. 16, 2017

(51) Int. Cl.
*D05C 9/04* (2006.01)
*D05C 13/00* (2006.01)

(52) U.S. Cl.
CPC ..... *D05C 9/04* (2013.01); *D05C 13/00* (2013.01)

(58) Field of Classification Search
CPC ... D05C 9/02; D05C 9/04; D05C 9/06; D05C 9/10; D05C 9/12; D05C 9/14
See application file for complete search history.

(56) References Cited

U.S. PATENT DOCUMENTS 4,767,111 A * 8/1988 Guenther ..... D05C 13/00 248/454
4,981,092 A * 1/1991 Bauman ..... D05C 9/04 112/102
5,427,043 A * 6/1995 Conley, Jr. ..... D05B 39/00 112/102.5
5,590,613 A * 1/1997 Head ..... D05C 9/04 112/103
5,664,350 A * 9/1997 Moore, III ..... D05C 1/02 38/102.2
5,860,375 A * 1/1999 Williams ..... D05C 1/02 112/103
6,336,416 B1 * 1/2002 French ..... D05C 9/04 112/103
6,679,190 B1 * 1/2004 French ..... D05C 9/04 112/103
7,100,523 B2 * 9/2006 Terao ..... D05C 9/04 112/103
7,377,222 B1 * 5/2008 Moore, III ..... D05B 35/04 112/103
7,584,708 B1 * 9/2009 Viltrakis ..... D05C 9/04 112/103

(Continued)

*Primary Examiner* — Danny Worrell, Jr.
(74) *Attorney, Agent, or Firm* — NK Patent Law, PLLC

(57) ABSTRACT

An apparatus for mounting a dual hoop assembly onto a selected area of an article includes: a frame; a platen assembly mounted upon the frame, the platen assembly including a face panel movable relative to the frame in at least two dimensions, the face panel configured to carry an article to which a dual hoop assembly is to be mounted; a pressing arm mounted upon the frame and carrying a press configured to support a first portion of a dual hoop assembly, the pressing arm movable relative to the frame to move the press in a travel path toward the platen assembly; and a positioning plate mounted upon the frame and extending between the platen assembly and pressing arm, the positioning plate configured to support a second portion of the dual hoop assembly in the travel path of the press.

19 Claims, 6 Drawing Sheets

(56) References Cited

U.S. PATENT DOCUMENTS

| | | | | |
|---|---|---|---|---|
| 7,966,957 | B2 * | 6/2011 | Mack | D05C 9/04 112/103 |
| 9,032,887 | B2 * | 5/2015 | Viltrakis | D05C 9/04 112/103 |
| 9,194,070 | B2 * | 11/2015 | Kawaguchi | D05C 9/06 |

* cited by examiner

EMBROIDERY HOOP MOUNTING APPARATUS AND METHOD

TECHNICAL FIELD

The present disclosure relates to preparing garments and other articles for embroidery and other treatments. More particularly, the present disclosure relates at least to an apparatus and method for mounting a dual embroidery hoop assembly onto an article.

BACKGROUND

Customization or decoration of garments and other articles is often directed to favorite sporting teams and commercial logos and slogans. Embroidery and other treatments are applied to customize and decorate garments and other articles often after first manufacture of the articles, for example by third parties that resell or redistribute the articles or decorate them to fill customer orders.

Although the numbers of custom jobs might not be as great as original manufacturing runs, time and error costs are to be minimized in embroidery and other treatments and accuracy of the placement of a treatment is of great importance. Thus improvements in efficiency in placing and performing embroidery and other treatments are needed.

SUMMARY

This summary is provided to introduce in a simplified form concepts that are further described in the following detailed descriptions. This summary is not intended to identify key or essential features of the claimed subject matter, nor is it to be construed as limiting the scope of the claimed subject matter.

In at least one embodiment, an apparatus for mounting a dual hoop assembly onto a selected area of an article includes: a frame; a platen assembly mounted upon the frame, the platen assembly including a face panel movable relative to the frame in at least two dimensions, the face panel configured to support an article to which a dual hoop assembly is to be mounted; a pressing arm mounted upon the frame and carrying a press configured to support a first portion of a dual hoop assembly, the pressing arm movable relative to the frame to move the press in a travel path toward the platen assembly; and a positioning plate mounted upon the frame and extending between the platen assembly and pressing arm, the positioning plate configured to support a second portion of the dual hoop assembly in the travel path of the press.

In at least one example, the platen assembly includes a base panel mounted upon the frame and movable relative to the frame in one of the two dimensions, wherein the face panel is mounted upon the base panel and is movable relative to the base panel in the other of the two dimensions.

In at least one example, at least one sliding cuff retains the base panel and face panel as parallel.

In at least one example, a fixed bracing arm extends from the frame and supports the platen assembly in any position of the platen assembly.

In at least one example, the face panel is configured to carry a clothing article to which a dual hoop assembly is to be mounted and is shaped to simulate a portion of a human form corresponding to the clothing article.

In at least one example, the apparatus further includes: a horizontal beam fixedly connected to the frame; and at least one clamp mounting the base panel to the horizontal beam, wherein the clamp can be loosened to permit sliding of the base panel along the horizontal beam and tightened to prevent sliding of the base panel along the horizontal beam.

In at least one example, the apparatus further includes at least one sliding cuff that retains the base panel and face panel as parallel and permits movement of the face panel in a direction that is perpendicular to the horizontal beam.

In at least one example, the direction in which the sliding cuff permits movement of the face panel is at least partially vertical.

In at least one example, the press includes a circular shaped portion extending toward the platen assembly and a wider flange facing the pressing arm.

In at least one example, the press is connected to the pressing arm by a hinging coupling permitting the press to pivot relative to the pressing arm.

In at least one example, the apparatus further includes a pair of hinge arms and a hinge extending between the hinge arms, wherein the pressing arm is mounted upon the hinge pin.

In at least one example, the pressing arm includes a lower arm portion and an upper arm portion extending oppositely from each other from the hinge pin, wherein the upper arm portion carries the press.

In at least one example, the apparatus further includes an actuator attached to the lower arm portion to force the upper arm portion toward the platen assembly upon actuation of the actuator.

In at least one example, the actuator is hingedly attached to the lower arm portion to accommodate swinging action of the lower arm portion as the pressing arm pivots around the hinge pin.

In at least one example, the actuator includes a pneumatic bidirectional linear movement device.

In at least one example, the positioning plate defines a cutout shaped to receive an outer hoop of the dual hoop assembly.

In at least one embodiment, a method of mounting a dual hoop assembly onto a selected area of an article includes: positionally adjusting a face panel of a platen assembly in at least one of two dimensions in which the face panel is movable relative to a frame that supports the platen assembly; supporting a first portion of a dual hoop assembly with a press mounted on a pressing arm hingedly mounted upon the frame; supporting a second portion of a dual hoop assembly with a positioning plate fixedly mounted upon the frame and extended between the pressing arm and platen assembly; placing an article, onto which the first and second portions of the dual hoop assembly are to be mounted, at least between the press and positioning plate; hinging the pressing arm toward the platen assembly causing the press and the first portion of the dual hoop assembly to travel toward the positioning plate and second portion of the dual hoop assembly and causing the article to be trapped between the first and second portions of the dual hoop assembly.

In at least one example, positionally adjusting the face panel includes positioning a base panel of the platen assembly along a horizontal beam while carrying the face panel by the base panel.

In at least one example, positionally adjusting the face panel further includes sliding the face panel relative to the base panel in a direction that is perpendicular to the horizontal beam.

In at least one example, the direction that is perpendicular to the horizontal beam is at least partially vertical.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1:
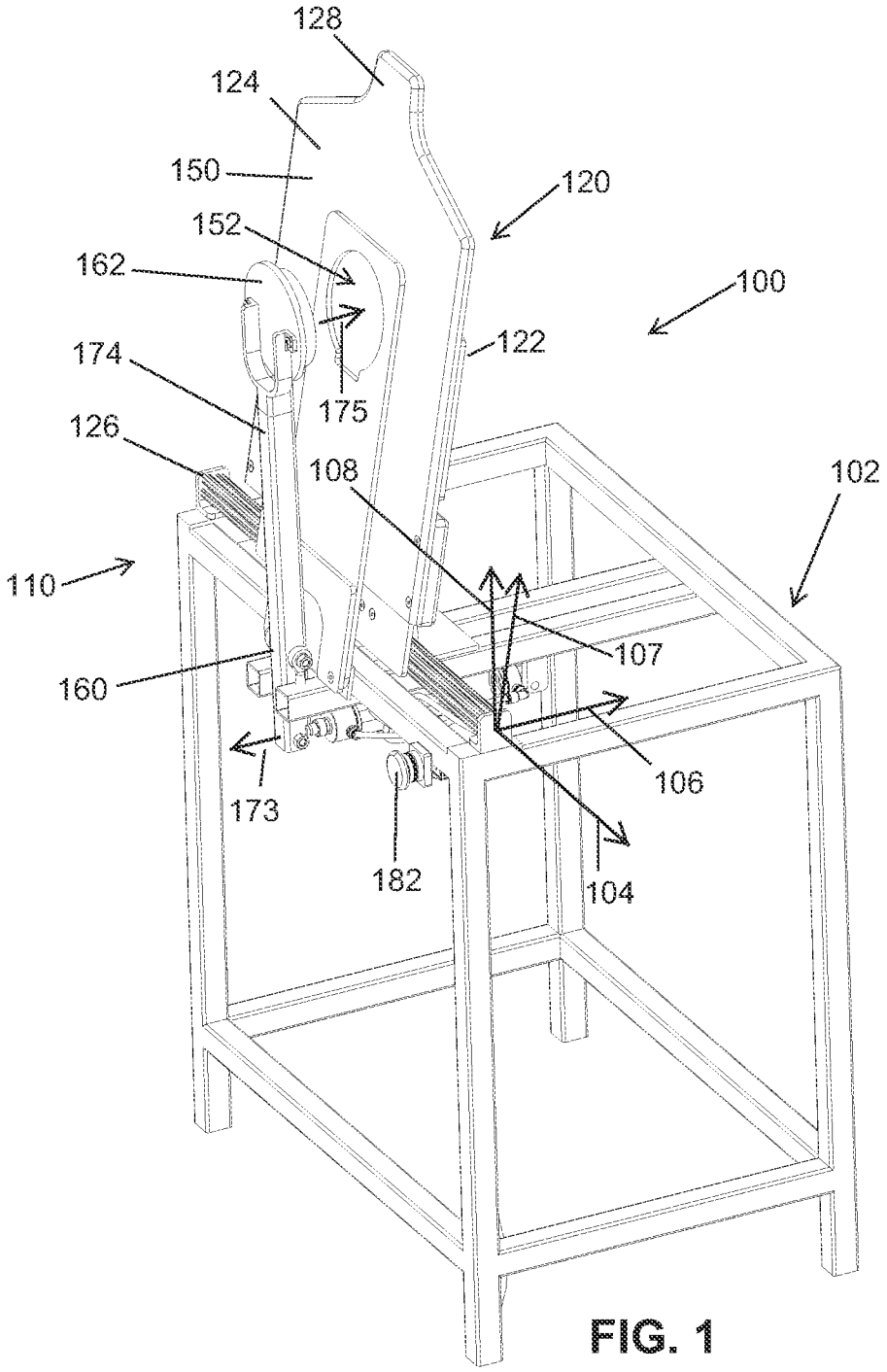
FIG. 1 is a perspective view of an apparatus, according to at least one embodiment, for selectively mounting a hoop assembly onto a selected area of an article to which embroidery or other treatment is to be applied.

These descriptions are presented with sufficient details to provide an understanding of one or more particular embodiments. Considerations in view of these descriptions will likely give rise to additional and similar embodiments and features. Although the term "step" may be expressly used or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

FIG. 1 is a perspective view of an apparatus 100 (FIGS. 1-4), according to at least one embodiment, for selectively mounting a dual hoop assembly 200 (FIG. 8) onto a selected area of an article 240, which could be a shirt, any other garment, and any other non-garment article to which embroidery or other treatment is to be applied. Advantageous features of the apparatus 100 permit accurate and repeated placements of a dual hoop assembly 200 onto multiple articles one at a time in the illustrated embodiment.

The apparatus 100 includes a frame 102, having multiple vertical legs and horizontal members. The frame 102 serves as a stable base for the remainder of the apparatus 100 luring use. Within these descriptions, in order to establish conventions for clarity, a first direction shown as horizontal in the drawings is nominally indicated as the X direction 104, a second horizontal direction perpendicular to the X direction 104 is indicated as the Y direction 106, and a third direction shown as vertical in the drawings is nominally indicated as the Z direction 108, such that the orthogonal X, Y and Z directions are used to describe movements of components of the apparatus 100 in three dimensions. Such distinctions as horizontal and vertical however are only nominal and relative, and rely upon the orientation of the apparatus, which orientation may vary in practice without escaping the scope of these descriptions. For convention, elements positioned relatively further in the Y-direction 106 are described as rearward, such that the frontal side 110 of the apparatus 100 is that conveniently approached by a user for operation purposes.

Figure 4:
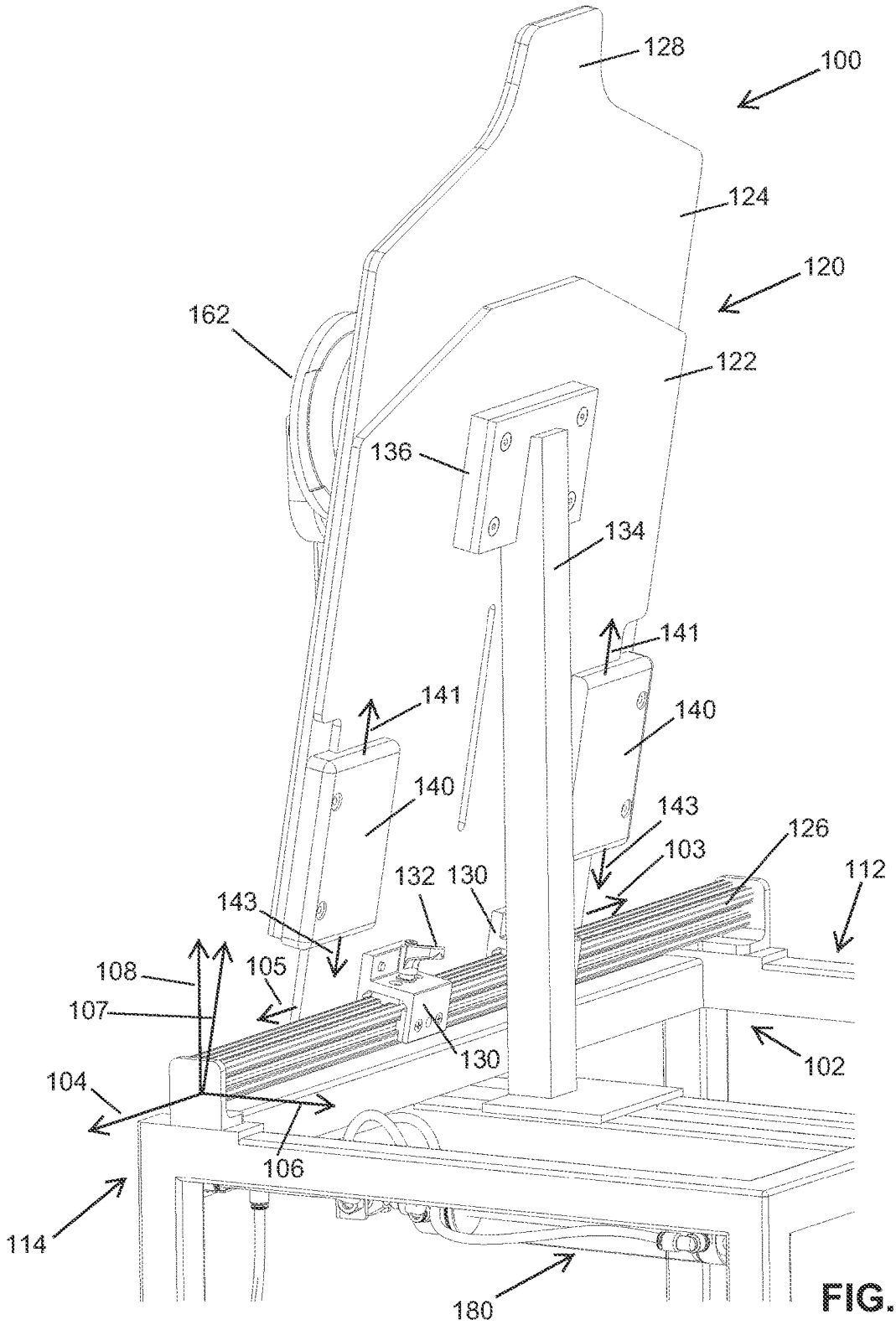
FIG. 4 is rear perspective view of back portions of the apparatus of FIG. 1, showing degrees of position adjustment of the platen assembly.

The apparatus 100 includes a platen assembly 1120 having rearward base panel 1122 and forward face panel 124 that defines the working surface of the platen assembly 120. The platen assembly 120 is mounted upon a horizontal beam 126 that extends along the X direction 104 from the left side 112 to the right side 114 of the top of the frame 102. As shown at least in FIG. 4, clamps 130 attached to the back surface of the base panel 122 mount the platen assembly 1120 to the horizontal beam 126 at a selectable position along the X direction 104. Each clamp 130 can be loosened by operation of a respective lever 132 to permit sliding of the platen assembly 120 along the horizontal beam 126 as indicated in FIG. 4 by a left movement arrow 103 and a right movement arrow 105. Each clamp 130 can be tightened by operation of the lever 132, for example by clockwise rotation, to lock the horizontal position of the platen assembly 120. In the illustrated embodiment, the platen assembly 120 is reclined partially in the Y direction 106 from the Z direction 108 such that the lower edge of the assembly 120 is forward of the top contoured end 128 of the forward face panel 124. Thus a reclined direction 107 is defined as parallel to the panels 122 and 124 and has both Z direction 108 and Y direction 106 components.

In the illustrated embodiment, the platen assembly 120, and particularly the forward face panel 124 thereof, are dimensioned to receive a garment such as a shirt. Thus the top contoured end 128 of the forward face panel 124 appears to simulate the frontal or real silhouette of a human form. A shirt can be placed upon the illustrated platen assembly 120 in like fashion to a person donning a shirt. In other embodiments, the platen assembly 120 can be dimensioned and shaped to receive other garments or articles.

A bracing arm 134 (FIG. 4) extends vertically from the frame 102 along the Z direction 108 behind the platen assembly 120 and supports a sliding abutment pad 136 that supports the platen assembly 120 from behind preventing unwanted Y direction 106 movement by flexure when force is borne by the forward face panel 124 when in use as described in the following. The abutment pad 136 is reclined to match the rear surface of the rearward base panel 122. The bracing arm 134 maintains the abutment pad 136 in a generally fixed position relative to the frame 102 as the platen assembly 120 is positionally adjusted so as to support the platen assembly 120 from behind in any position thereof.

Left and right side sliding cuffs 140 extending from the back surface of the forward face panel 124 capture the rearward base panel 122 and permit sliding movement of the face panel relative to the base panel 122 in the reclined direction 107, as indicated in FIG. 4 by a first partially upward movement arrow 141, and opposite the reclined direction 107 as indicated in FIG. 4 by a second partially downward movement arrow 143. The face panel 124 and base panel 122 are held in parallel contact by the cuffs and travel left and right together when the clamps 130 are loosened and moved upon the horizontal beam 126. The face panel 124 travels along the reclined direction 107 relative to the base panel 122 in a range of motion defined by movement of the sliding cuffs 140 along a lower portion of rearward base panel 122 that is narrowed with respect to the X direction 104 to be captured between the cuffs 140. Thus two degrees of linear motion, one along the X direction 104 and one along the Y direction 107, are available for selective positional adjustment of the forward face panel 124 relative to the frame 102 in two dimensions (2D).

Figure 2:
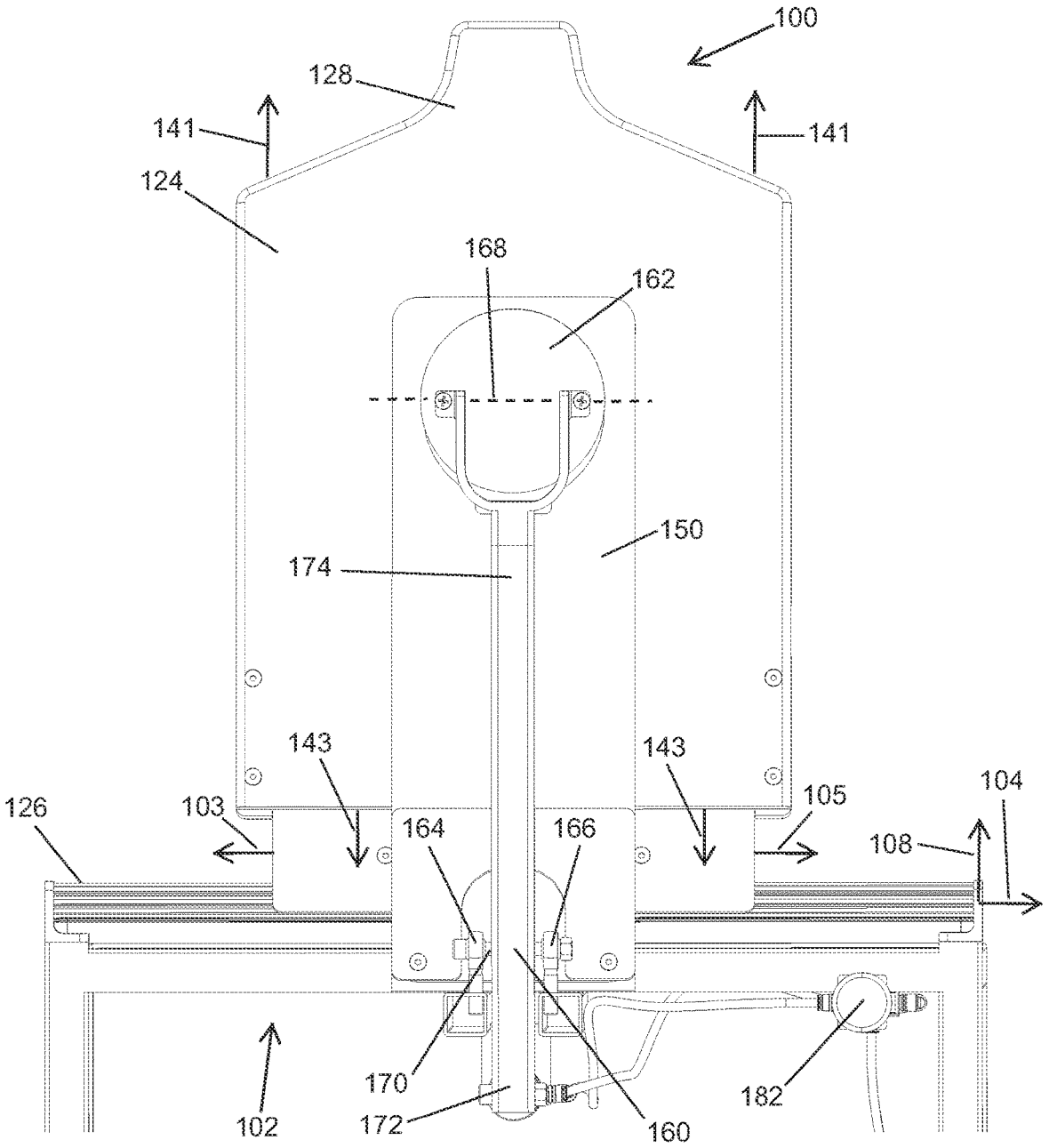
FIG. 2 is a front elevation view of upper portions of the apparatus of FIG. 1, showing a pressing arm and platen assembly of the apparatus.
Figure 3:
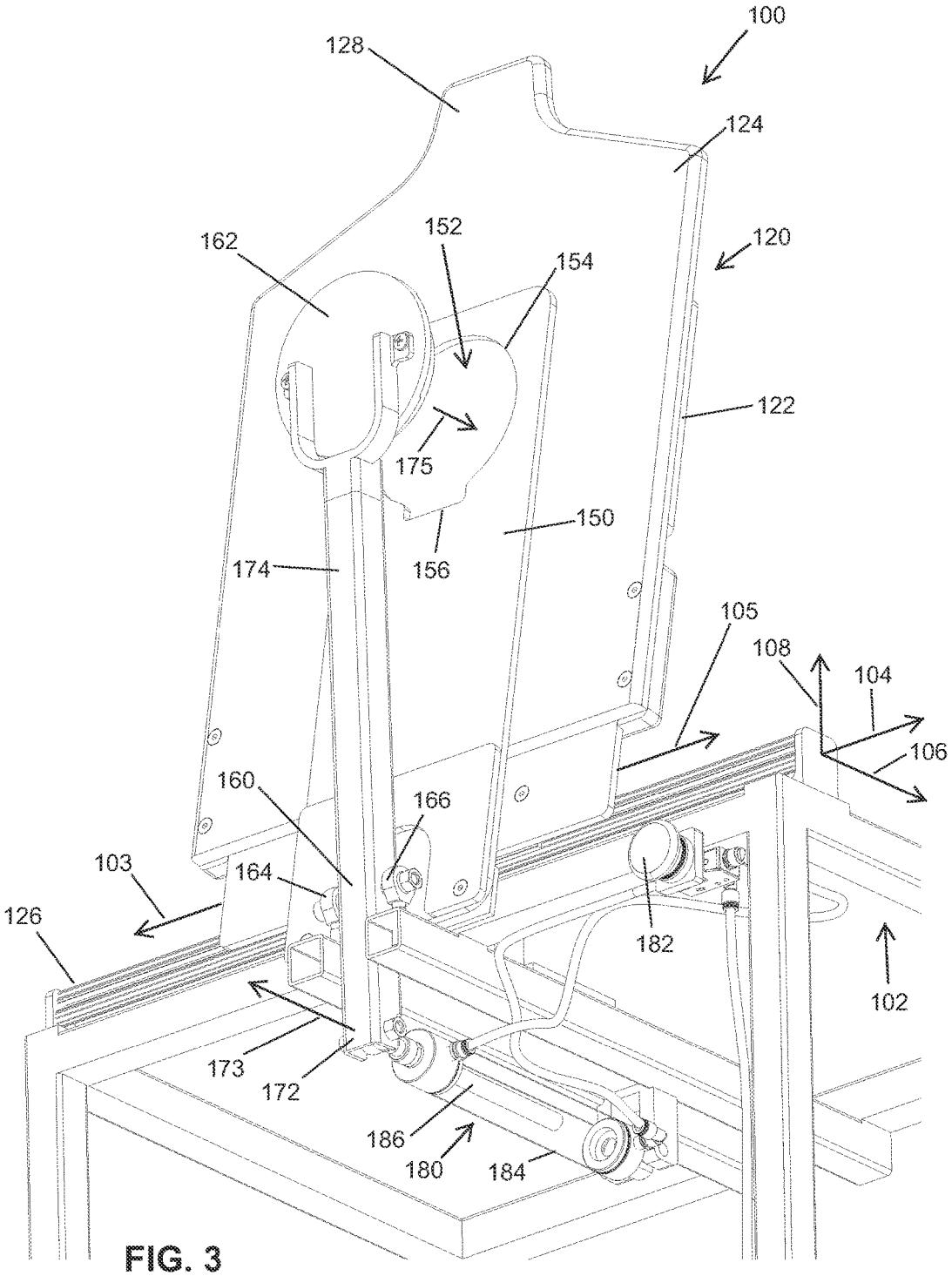
FIG. 3 is a perspective view of front portions of the apparatus of FIG. 1, showing an actuator that causes movement of the pressing arm toward the platen assembly.

A hoop positioning plate 150 (FIGS. 1-2) extends upward from the frame 102 along the reclined direction 107 forward of and generally parallel to the platen assembly 120. As shown in FIGS. 1 and 3, the hoop positioning plate 150 defines a cutout 152 shaped to receive, for example, an outer hoop 230 (FIG. 7) of a dual hoop assembly 200 (FIG. 8). Thus, in the illustrated example, the cutout 152 has a generally circular portion 154 (FIG. 3) sized to receive the outer circumference of the circular band of the outer hoop, and an additional relief portion 156 sized to receive the terminal ends. The hoop positioning plate 150 remains in a generally fixed position relative to the frame 102 as the platen assembly 120 and forward face panel 124 thereof are positionally adjusted. Thus, the location of a dual hoop assembly 200 to be applied to upon an article is selected by positional adjustments of the platen assembly 120 and forward face panel 124 thereof.

An actuating pivoting pressing arm 160 extends upward from the frame 102 and supports a press 162 configured to support, for example, the base portion 210 (FIG. 5) of a dual hoop assembly 200 (FIG. 8) when a dual hoop assembly 200 is to be applied to an article. Accordingly; in the illustrated example, the press 162 has a circular shaped portion extending toward the platen assembly 120 to be received in an inner hoop 212 carried by the press, and a wider flange facing the pressing arm 160 to prevent over-insertion of the press into the inner hoop 212. By pivoting movement of the pressing arm 160 relative to the frame 102, the press 162 approaches the hoop positioning plate 150 such that a dual hoop assembly 200 (FIG. 8) can be pressed upon an article placed between the pressing arm 160 and hoop positioning plate 150. In the illustrated embodiment, a left hinge arm 164 and a right hinge arm 166 extend upward from the frame 102. A hinge pin 170 passes through the hinge arms and pressing arm 160 to pivotally mount the pressing an to the frame 102 with the hinge pin and hinge arms 164 and 166 (FIG. 3) serving as a fulcrum or hinging point. The pressing arm 160 extends in two directions from the hinge pin 170, with an upper arm portion 174 of the pressing arm extending upward to support and carry the press 162, and a lower arm portion 172 of the pressing arm extending downward to engage an actuator 180 (FIG. 3) connected to the frame 102.

Upon actuation of the actuator 180, the lower arm portion 172 is forced forward as indicated by a movement arrow 173 in FIGS. 1 and 3. By pivotal movement of the pressing arm 160 around the fulcrum defined by the hinge arms and hinge pin 170, the upper arm portion 174 and press 162 are forced forward toward the hoop positioning plate 150 and platen assembly 120 as indicated by a movement arrow 175 in FIGS. 1 and 3. Reversal movement of the pressing arm 160, whether by forceful reverse actuation of the actuator or by its passive allowance, withdraws the upper arm portion 174 and press 162 from the hoop positioning plate 150 and platen assembly 120.

In the illustrated embodiment, the actuator 180 is shown as a pneumatic bidirectional linear movement device powered by connected air lines coupled to a control switch 182. The control switch 182 may be arranged for actuation by hand as illustrated, or may be arranged elsewhere, for example to be actuated by foot for hands-free operation. The actuator 180 includes a pressure cylinder 184 and piston 186, which is forced in two directions by application of air pressure or other fluid pressure at two opposing end of the cylinder 184. The actuator 180 is hingedly attached at its opposing ends to the frame 102 and lower arm portion 172 to accommodate swinging action as the pressing arm 160 pivots around the hinge pin 170 and hinge arms 164 and 166. Various other types of actuators and mechanical couplings are within the scope of these descriptions. Various control configurations are within the scope of these descriptions as well. In at least one example, pressing of the control switch 182 causes forced actuation of the press 162 toward the hoop positioning plate 150 and platen assembly 120 and its release causes forced withdraw of the press 162.

The pressing arm 160 (FIG. 3) is dimensioned to align the press 162 with the cutout 152 defined by the hoop positioning plate 150 as the press approaches the platen assembly 120 in its travel path forcing the press 162 toward the platen assembly 120. This arrangement aligns a base portion 210 (FIG. 5) of a dual hoop assembly 200 (FIG. 8) as carried by the press 162 with an outer hoop portion (FIG. 7) as supported by the hoop positioning plate 150. As represented in FIG. 2, in at least one embodiment, the attachment of the press 162 to the pressing arm 160 is made by a hinging coupling permitting the press 162 to pivot around horizontal axis 168. This arrangement permits alignment tolerance between a base portion 210 (FIG. 5) of a dual hoop assembly 200 (FIG. 8) and an outer hoop 230 upon actuation of the press. In any position of the platen assembly 120 and face panel 124, the travel path of the pressing arm 160 and hoop positioning plate 150 are maintained by the frame 102 in a fixed relationship to align the press 162 with the cutout 152 as the press approaches the platen assembly. The press 162 is removable from the pressing arm in at least one embodiment, for example to permit multiple sizes to be installed.

Figure 5:
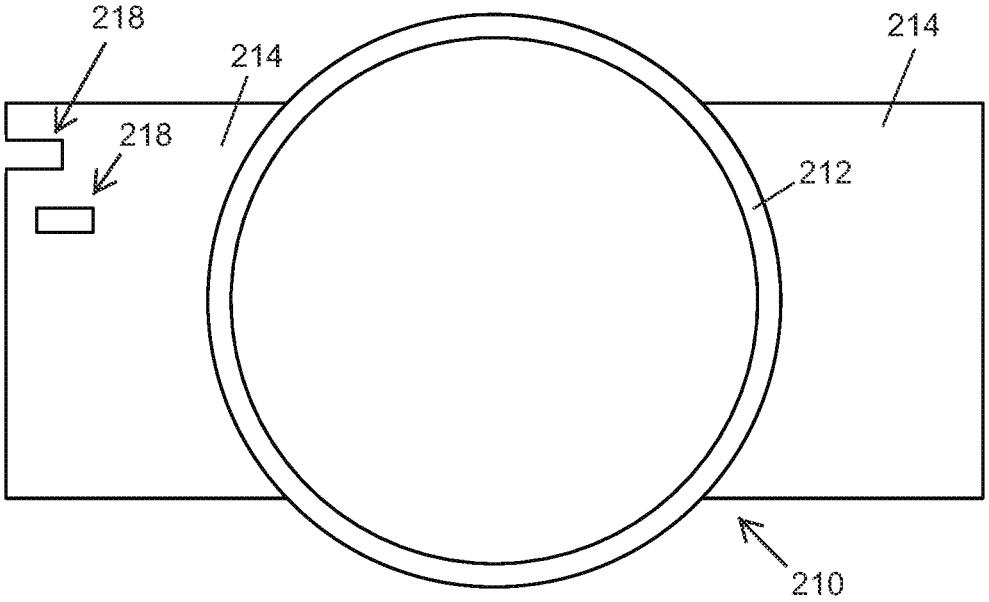
FIG. 5 is a plan view of a base portion of a dual hoop assembly, including an inner hoop having tabs at diametrically opposite sides, according to at least one embodiment.
Figure 6:
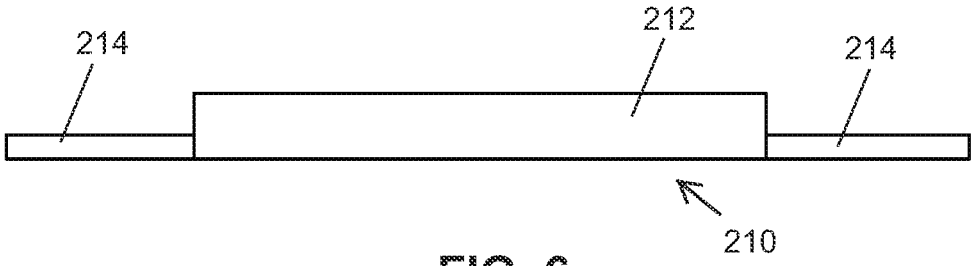
FIG. 6 is an elevation view of the base portion of FIG. 5.

FIG. 5 is a plan view of a base portion 210 of a dual hoop assembly 200 (FIG. 8) including an inner hoop 212 having rectangular ended tabs 214 attached thereto at diametrically opposite sides of the inner hoop 212, according to at least one embodiment. FIG. 6 is an elevation view of the base portion 210 of FIG. 5, showing the tabs 214 as coplanar and extending in opposite directions from the inner hoop 212, with the inner hoop extending in a normal direction from the tabs 214. Registration cutouts 218 are defined by at least one of the tabs 214 to assure positioning and unambiguous orientation of the base portion 210 when in use.

Figure 7:
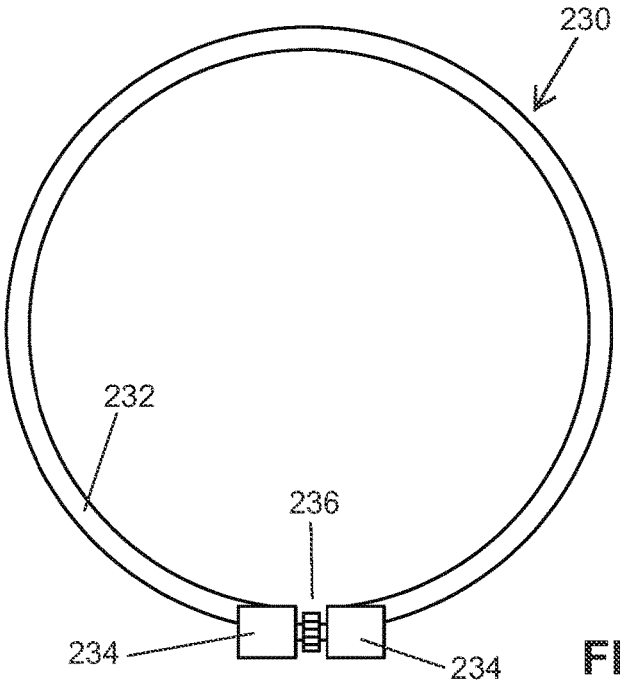
FIG. 7 is a plat view of an outer hoop of a dual hoop assembly, according to at least one embodiment.
Figure 8:
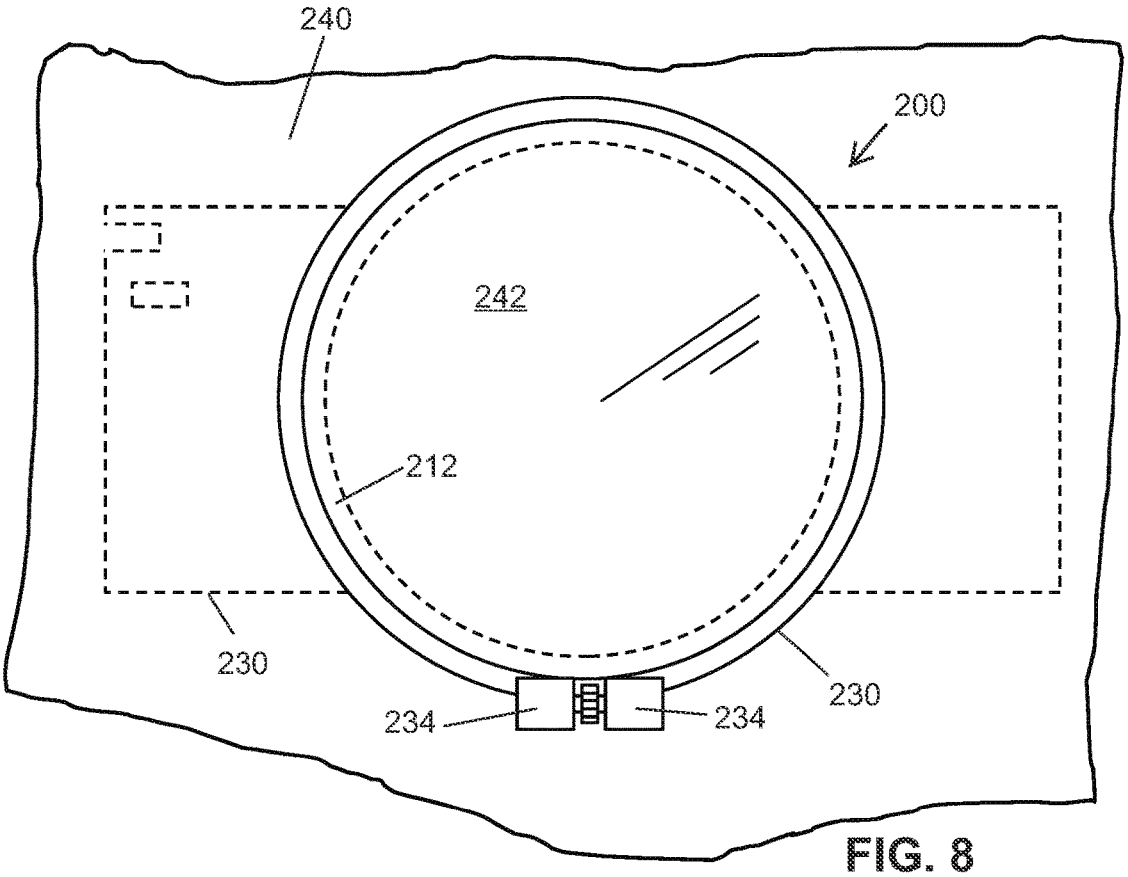
FIG. 8 is a plan view of an article to which embroidery or other treatment is to be applied by use of a dual hoop assembly formed by engagement of the base portion of FIG. 6 and outer hoop of FIG. 7.

FIG. 7 is a plan view of an outer hoop 230 of a dual hoop assembly 200 (FIG. 8), according to at least one embodiment, including a generally circular circumferentially uniform band 232 having enlarged terminal ends 234 that engage opposing ends of an adjustable fastener 236. In the illustrated embodiment, the fastener 236 is shown as a rod centrally upon which a toothed disk is attached for turning of the rod relative to the terminal ends 234 of the band. Opposing ends of the rod are oppositely outwardly threaded and engaged by the terminal ends 234 of the band, which are correspondingly oppositely inwardly threaded. Thus the outer hoop 230 is tightened and loosened in clamping action by the turning of the adjustable fastener 236 in turnbuckle fashion.

FIG. 8 is a plan view of an article 240 to which embroidery or other treatment is to be applied by use of a dual hoop assembly 200 formed by engagement of the base portion 210 and outer hoop 230. The article 240 is engaged between the cylindrical outer wall of the inner hoop 212 and cylindrical inner wall of the outer hoop 230, with the adjustable fastener 236 applying appropriate circumferential tension to retain the article in the dual hoop assembly 200 as shown. As shown, the inner hoop 212 and outer hoop 230 contact opposite surface sides of the article. An inner portion 242 of the article is maintained as generally planar and somewhat taut as desired for embroidery and other treatments. The registration cutouts 218 of the base portion 210 assure positioning and unambiguous orientation of the dual hoop assembly 200 when in use in an embroidery or other treatment machine or process. In the configuration of FIG. 8, accurately located and executed embroidery or other treatment can be reliably applied to the article 240, particularly the inner portion 242 of the article, by automated process for example.

The configuration of FIG. 8 is advantageously achieved by use of the apparatus 100 (FIGS. 1-4) as described in the following. With reference to the X direction 104, horizontal positional adjustment of the platen assembly 120 along the along the horizontal beam 126 is conducted and each clamp 130 is locked. With reference to the reclined direction 107, positional adjustment of the forward face panel 124 along the rearward base panel 122 is conducted as permitted by the sliding cuffs 140. These two positional adjustments determine the position of the face panel 124 of the platen assembly 120 relative to the hoop positioning plate 150 and pressing arm 160, and accordingly determine the positions of an outer hoop 230 received in the cutout 152 and a base portion 210 carried by the press 162 relative to an article 240 placed over the platen assembly 120 and hoop positioning plate 150. Two such positional adjustments, the placement of an outer hoop 230 in the cutout 152, the placement of a base portion 210 upon the press 162, and placement of an article 240 upon the platen assembly 120 and hoop positioning plate 150, can be conducted in any order. An operator can confirm the positional adjustments by apparent position of the outer hoop 230 through the article 240, which may be visible through some articles and may at least cause some apparent rise in others at the position of the outer hoop.

Upon actuation of the actuator 180, for example by manipulation of the switch 182, the press 162 is forced toward the platen assembly 120, with the article 240 trapped between the a base portion 210, which is carried by the press 162, and the outer hoop 230, which is firmly supported by the positioning plate and platen assembly 120. Accordingly, the article 240 is forcefully formed between and retained by the base portion 210 outer hoop 230, which assume the dual hoop assembly 200 configuration as shown in FIG. 8. Upon withdrawal of the press 162, the article 240 with the dual hoop assembly 200 attached thereto, can be removed from the apparatus for embroidery or other treatment by use of the dual hoop assembly 200. Additional outer hoops 230, base portions 210 and articles 240 can then be similarly placed upon the apparatus and similarly treated. Insofar as the position of the forward face panel 124 is maintained between apparatus operations, the attachments of dual hoop assemblies 200 upon same or similar articles occur at same or similar locations upon the articles.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. An apparatus for mounting a dual hoop assembly onto a selected area of an article, the apparatus comprising:

a frame;

a platen assembly mounted upon the frame, the platen assembly comprising a face panel movable relative to the frame in at least two dimensions, the face panel configured to support an article to which a dual hoop assembly is to be mounted, wherein the platen assembly comprises a base panel mounted upon the frame and movable relative to the frame in one of the two dimensions, and the face panel is mounted upon the base panel and is movable relative to the base panel in the other of the two dimensions;

one or more cuffs extending from a back surface of the face panel that permit movement of the face panel relative to the frame;

a pressing arm mounted upon the frame and carrying a press configured to support a first portion of a dual hoop assembly, the pressing arm movable relative to the frame to move the press in a travel path toward the platen assembly; and a positioning plate mounted upon the frame and extending between the platen assembly and pressing arm, the positioning plate configured to support a second portion of the dual hoop assembly in the travel path of the press.

2. An apparatus according to claim 1, further comprising at least one sliding cuff that retains the base panel and face panel as parallel.

3. An apparatus according to claim 1, further comprising a fixed bracing arm extending from the frame and supporting the platen assembly in any position of the platen assembly.

4. An apparatus according to claim 1, wherein the face panel is configured to carry a clothing article to which a dual hoop assembly is to be mounted and is shaped to simulate a portion of a human form corresponding to the clothing article.

5. An apparatus according to claim 1, further comprising:

a horizontal beam fixedly connected to the frame; and at least one clamp mounting the base panel to the horizontal beam, wherein the clamp can be loosened to permit sliding of the base panel along the horizontal beam and tightened to prevent sliding of the base panel along the horizontal beam.

6. An apparatus according to claim 5, further comprising at least one sliding cuff that retains the base panel and face panel as parallel and permits movement of the face panel in a direction that is perpendicular to the horizontal beam.

7. An apparatus according to claim 6, wherein the direction in which the sliding cuff permits movement of the face panel is at least partially vertical.

8. An apparatus according to claim 1, wherein the press comprises a circular shaped portion extending toward the platen assembly and a wider flange facing the pressing arm.

9. An apparatus according to claim 8, wherein the press is connected to the pressing arm by a hinging coupling permitting the press to pivot relative to the pressing arm.

10. An apparatus according to claim 1, further comprising a pair of hinge arms and a hinge pin extending between the hinge arms, wherein the wherein the pressing arm is mounted upon the hinge pin.

11. An apparatus according to claim 10, wherein the pressing arm comprises a lower arm portion and an upper arm portion extending oppositely from each other from the hinge pin, wherein the upper arm portion carries the press.

12. An apparatus according to claim 11, further comprising an actuator attached to the lower arm portion to force the upper arm portion toward the platen assembly upon actuation of the actuator.

13. An apparatus according to claim 12, wherein the actuator is hingedly attached to the lower arm portion to accommodate swinging action of the lower arm portion as the pressing arm pivots around the hinge pin.

14. An apparatus according to claim 13, wherein the actuator comprises a pneumatic bidirectional linear movement device.

15. An apparatus according to claim 1, wherein the positioning plate defines a cutout shaped to receive an outer hoop of the dual hoop assembly.

16. A method of mounting a dual hoop assembly onto a selected area of an article, the method comprising:

positionally adjusting a face panel of a platen assembly in at least one of two dimensions in which the face panel is movable relative to a frame that supports the platen assembly, wherein the platen assembly comprises a base panel mounted upon the frame and movable relative to the frame in one of the two dimensions, and the face panel is mounted upon the base panel and is movable relative to the base panel in the other of the two dimensions;

supporting a first portion of a dual hoop assembly with a press mounted on a pressing arm hingedly mounted upon the frame;

supporting a second portion of a dual hoop assembly with a positioning plate fixedly mounted upon the frame and extended between the pressing arm and platen assembly;

placing an article, onto which the first and second portions of the dual hoop assembly are to be mounted, at least between the press and positioning plate;

hinging the pressing arm toward the platen assembly causing the press and the first portion of the dual hoop assembly to travel toward the positioning plate and second portion of the dual hoop assembly and causing the article to be trapped between the first and second portions of the dual hoop assembly.

17. A method according to claim 16, wherein positionally adjusting the face panel comprises positioning the base panel of the platen assembly along a horizontal beam while carrying the face panel by the base panel.

18. A method according to claim 17, wherein positionally adjusting the face panel further comprises sliding the face panel relative to the base panel in a direction that is perpendicular to the horizontal beam.

19. An apparatus according to claim 18, wherein the direction that is perpendicular to the horizontal beam is at least partially vertical.

* * * * *